US005923933A

United States Patent [19]

Anzai et al.

[11] Patent Number: 5,923,933

[45] Date of Patent: Jul. 13, 1999

[54] ELECTROPHOTOGRAPHIC APPARATUS

[75] Inventors: Masayasu Anzai, Hitachi; Tsuneaki Kawanishi, Toukai-mura; Yoshitaka Fujinuma; Hiroyoshi Matsumoto, both of Hitachinaka; Yasuo Takuma; Hisao Okada, both of Hitachi; Masayuki Ainoya, Mito; Takashi Suzuki, Hitachinaka; Yuichiro Suzuki, Toukai-mura; Tomonari Hokkyo, Hitachinaka; Koji Kato, Hitachinaka; Katsuya Kawai, Hitachinaka; Tsutomu Nakagawa, Hitachinaka, all of Japan

[73] Assignee: Hitachi Koki Co., Ltd., Tokyo, Japan

[21] Appl. No.: 09/023,462

[22] Filed: Feb. 13, 1998

[30] Foreign Application Priority Data

| | | | |
|---|---|---|---|
| Feb. 21, 1997 | [JP] | Japan | 9-037946 |
| Mar. 14, 1997 | [JP] | Japan | 9-060876 |
| Sep. 26, 1997 | [JP] | Japan | 9-261984 |

[51] Int. Cl.[6] ..... G03G 15/09

[52] U.S. Cl. ..... 399/269; 399/270

[58] Field of Search ..... 399/222, 267, 399/269, 270, 282, 289

[56] References Cited

U.S. PATENT DOCUMENTS

| | | | |
|---|---|---|---|
| 4,442,790 | 4/1984 | Swapceinski et al. . | |
| 4,637,973 | 1/1987 | Shigeta et al. | 399/267 X |
| 5,300,987 | 4/1994 | Aoyama et al. | 399/269 X |
| 5,416,571 | 5/1995 | Yamada et al. | 399/269 |
| 5,491,537 | 2/1996 | Suzuki et al. | 399/267 X |
| 5,630,201 | 5/1997 | Suzuki et al. | 399/269 |

FOREIGN PATENT DOCUMENTS

| | | |
|---|---|---|
| 54-10869 | of 1979 | Japan . |
| 63-15881 | of 1988 | Japan . |
| 1-503811 | 12/1989 | Japan . |

*Primary Examiner*—S. Lee

*Attorney, Agent, or Firm*—Antonelli, Terry, Stout & Kraus, LLP

[57] ABSTRACT

A uniform image is obtained by matching the sliding friction force, the moving speed and the developing agent in a developing region of two developing rollers and an electric characteristic of a photosensitive body used for image development. Two developing rollers rotating in directions opposite to each other are used, the moving direction of the first developing roller being opposite to the moving direction of the photosensitive body, and a circumferential speed ratio of a circumferential speed of the first developing roller to a circumferential speed of the photosensitive body is within a rage of 0.5 to 2.5; and the moving direction of the second developing roller is equal to the moving direction of the photosensitive body, and a circumferential speed ratio of a circumferential speed of the second developing roller to a circumferential speed of the photosensitive body is within a range of 1.5 to 3.5. A ratio of the sliding friction force between a magnetic brush for developing agent and the photosensitive body formed in the first developing roller and the sliding friction force between a magnetic brush for developing agent and the photosensitive body formed in the second developing roller is within a range of 0.9 to 2.1.

14 Claims, 6 Drawing Sheets

FIG.2

| S2 | WANING FRONT END OF SOLID BLACK PORTION FIG.8 (A) | WANING REAR END OF SOLID BLACK PORTION FIG.8 (A) | FRONT END OF WHITE HOLLOW PORTION FIG.8 (A) | REAR END OF WHITE HOLLOW PORTION FIG.8 (A) | THIN LINE STRIPE FIG.8 (B) | REAR END OF SOLID BLACK PORTION IN CROSSHACTCH FIG.8 (C) | FRONT END OF SOLID BLACK PORTION IN CROSSHACTCH FIG.8 (C) |
|---|---|---|---|---|---|---|---|
| 1.0 | × | ○ | ○ | × | ○ | ○ | × |
| 1.5 | △ | ○ | ○ | △ | ○ | ○ | △ |
| 2 | ○ | ○ | ○ | ○ | ○ | ○ | ○ |
| 2.5 | ○ | ○ | ○ | ○ | ○ | ○ | ○ |
| 3.0 | ○ | ○ | △ | ○ | △ | △ | ○ |
| 3.5 | ○ | △ | △ | ○ | △ | △ | ○ |
| 4.0 | ○ | × | × | ○ | × | × | ○ |

| F1 (gf / cm) | F1 / F2 | ABRASION | CLEANING EFFECT | IMAGE |
|---|---|---|---|---|
| 5.03 | 0.7 | ○ | × | △ |
| 6.83 | 0.9 | ○ | △ | ○ |
| 8.87 | 1.2 | ○ | ○ | ○ |
| 9.90 | 1.4 | ○ | ○ | ○ |
| 11.43 | 1.6 | ○ | ○ | ○ |
| 13 | 1.8 | ○ | ○ | △ |
| 15.23 | 2.1 | △ | ○ | △ |
| 17 | 2.3 | △ | ○ | × |

ELECTROPHOTOGRAPHIC APPARATUS

BACKGROUND OF THE INVENTION

The present invention relates to an electrophotographic apparatus which forms a toner image on a sheet of printing paper using an electrophotographic method or an electrostatic printing method; and, more particularly, the invention relates to an electrophotographic apparatus which develops a latent image formed on a photosensitive body using a developing agent having a magnetic carrier and a toner as main components and a first developing roller and a second developing roller rotating in directions opposite to each other and arranged along a moving direction of the photosensitive body.

A conventional electrophotographic method or electrostatic recording method, in which a latent image is formed on a photosensitive body and the latent image is developed using a two-component magnetic developing agent having a magnetic carrier and a toner as main components and two developing rollers rotating in the directions opposite to each other, is disclosed in Japanese Patent Publication No. 54-10869, Japanese Patent announcement Laid-Open No. 1-503811, Japanese Utility Model publication No. 63-15881 or U.S. Pat. No. 4,442,790.

The conventional method can prevent occurrence of unevenness in a developing direction in a high image density zone, since the developing ability is increased, but it has a problem in that unevenness remains in a direction of the developing brush in a low image density zone, particularly in a zone having an image density D smaller than 1 (one) and in a halftone image composed of mesh, crosshatch or lines, when a high resistance developing agent is used. Further, there are problems in that the size of such an apparatus becomes large since it has two developing rollers, and in that a large diameter drum needs to be used, and the printing speed is decreased particularly when the photo-response speed of the photosensitive body is slow. Furthermore, extension of the lifetime of the photosensitive body and the cleaner has not been sufficiently considered, and, accordingly, further improvement is required in order to obtain stable images for a long time.

FIG. 8(A) to FIG. 8(C) will be referred to for explaining image faults often observed in an image obtained by a conventional electrostatic latent image developing apparatus.

FIG. 8(A) is a print image of a white hollow portion 34 having a line width of 1 to 2 mm in a solid black portion 33 of approximately 3 cm square, and both the moving direction of the photosensitive drum and the relative moving direction of the developing brush are in a direction shown by an arrow in the figure. There occur a waning of the rear end portion 35, which is a phenomenon wherein the rear end portion of the solid black portion 33 is not clearly developed, and a lack of the front end portion 36 which is a phenomenon wherein the rear end portion of the white hollow portion 34 is difficult to develope. These phenomena are caused by the relative moving direction of the developing brush and an electric line of force in the periphery of the image portion. These phenomena become conspicuous, for example, when the image density D satisfies $D \leqq 1.2$, particularly in a low image density of $D \leqq 1$. When the developing ability is increased to a high image density of $D \geqq 1.2$, the phenomena become inconspicuous. However, the image of a white hollow thin line becomes difficult to reproduce, and in addition to this, the quantity of toner being consumed becomes large.

FIG. 8(B) shows an example of a print image of nearly one hundred thin lines 37 approximately 10 mm in length and 0.1 mm in width and having a spacing of approximately 0.2 mm (the total width of the thin line stripe is approximately 30 mm), and a bold line 39 approximately 10 mm in length and 3 mm in width arranged in front of the thin line stripe. In this case, there is a little waning of the rear end portion 38 in an area behind the bold line 39. This phenomenon is caused by the relative moving direction of the developing brush, an electric line of force in the periphery of the image portion and a charge induced in the carrier of the developing agent. This phenomenon becomes conspicuous, for example, when the image density D is smaller than 1 (one). When the developing ability is increased to a high image density, the phenomenon becomes inconspicuous. However, the image of the thin line stripe becomes difficult to reproduce.

FIG. 8(C) shows an example of a defective image occurring when a solid black portion 41 in a mesh or crosshatch portion 40 having 100 to 600 dots/inch is recorded. In this case, in addition to a waning of the rear end portion as described above, there occurs a decrease of the image density in the peripheral portion of the solid black portion or a fringe image 42 blanked in white, which is conspicuous in the rear portion compared to both side portions in the lateral direction and the front portions. This phenomenon is caused by the relative moving direction of the developing brush and an electric line of force in the periphery of the image portion. This phenomenon becomes conspicuous, for example, when the image density D is smaller than 1 (one). When the developing ability is increased to a high image density, the phenomenon becomes inconspicuous. However, the image of the mesh or crosshatch is apt to be crushed.

The inventors of the present invention have studied these image faults from various aspects and found that the image fault closely relates to a circumferential speed ratio between the first developing roller and the photosensitive body and a circumferential speed ratio between the second developing roller and the photosensitive body.

SUMMARY OF THE INVENTION

A first object of the present invention is to provide an electrophotographic apparatus capable of obtaining a good image quality by solving the above-mentioned faults in the conventional technology.

A second object of the present invention is to provide a comparably small sized electrophotographic apparatus capable of printing at a high speed without increasing the size of the photosensitive body.

A third object of the present invention is to realize an electrophotographic apparatus which is capable of obtaining a uniform image for a long period and is capable of extending the life-times of blade members, such as rubber blades composing an organic photoconductor photosensitive body and a cleaner.

The above-mentioned first object can be attained by an electrophotographic apparatus forming a latent image on a photosensitive body by exposing the charged photosensitive body using an exposing means, and developing the latent image using a two-component magnetic developing agent having a magnetic carrier and a toner as main components and a first developing roller and a second developing roller rotated in directions opposite to each other and arranged along a moving direction of the photosensitive body, wherein the moving direction of the first developing roller is opposite to the moving direction of the photosensitive body, and a circumferential speed ratio (S1=Vd1/Vp) of a circumferential speed (Vd1) of the first developing roller to a circumferential speed (Vp) of the photosensitive body is restricted in a range of 0.5 to 2.5; and the moving direction of the second developing roller is equal to the moving direction of the photosensitive body, and a circumferential speed ratio (S2=Vd2/Vp) of a circumferential speed (Vd2) of the second developing roller to a circumferential speed (Vp) of the photosensitive body is restricted in a range of 1.5 to 3.5.

The above-mentioned second object can be attained by coordinating the time required for rotating said photosensitive body, from an exposing position of the exposing means to a position between the first developing roller and the second developing roller, to the photo-response time of the photosensitive body.

The above-mentioned third object can be attained by an electrophotographic apparatus comprising a developing means for forming a toner image on a photosensitive body by forming a latent image combining exposed portions and non-exposed portions on the photosensitive body by exposing the charged photosensitive body using an exposing means, and developing the exposed portions using a developing agent having a magnetic carrier and a toner containing magnetite fine particles as main components and a first developing roller and a second developing roller rotated in directions opposite to each other and arranged along a moving direction of the photosensitive body; and a developing means for forming a toner image on the photosensitive body; and a cleaning means having a blade member for removing toner remaining on the photosensitive body after transferring the toner image to printing paper, provided so as to push onto the surface of the photosensitive body, wherein the moving direction of the first developing roller is opposite to the moving direction of the photosensitive body, and a circumferential speed ratio (S1=Vd1/Vp) of a circumferential speed (Vd1) of the first developing roller to a circumferential speed (Vp) of the photosensitive body is restricted in a range of 0.5 to 2.5; the moving direction of the second developing roller is equal to the moving direction of the photosensitive body, and a circumferential speed ratio (S2=Vd2/Vp) of a circumferential speed (Vd2) of the second developing roller to the circumferential speed (Vp) of the photosensitive body is restricted in a range of 1.5 to 3.5; and the first developing roller and the second developing roller also have a function to remove unnecessary toner remaining on the photosensitive body in the relationship of the circumferential speed ratios. By doing so, the pressure of pushing the blade member on the photosensitive body can be reduced, and consequently the abrasion quantity of the photosensitive body can be suppressed nearly to 1 to 3 $\mu$m per $10^5$ rotations even in a case of using a toner containing magnetic fine particles.

BRIEF DESCRIPTION OF THE DRAWINGS

FIG. 2 is a characteristic table summarizing evaluated results of image conditions in the laser printer of FIG. 1 when a circumferential speed ratio S2 between a second developing roller and a photosensitive body (a photosensitive drum) is varied while a circumferential speed S1 between a first developing roller and the photosensitive drum is being kept constant.

DETAILED DESCRIPTION OF THE PREFERRED EMBODIMENTS

An embodiment in accordance with the present invention will be described below, referring to the accompanied drawings.

Figure 1:
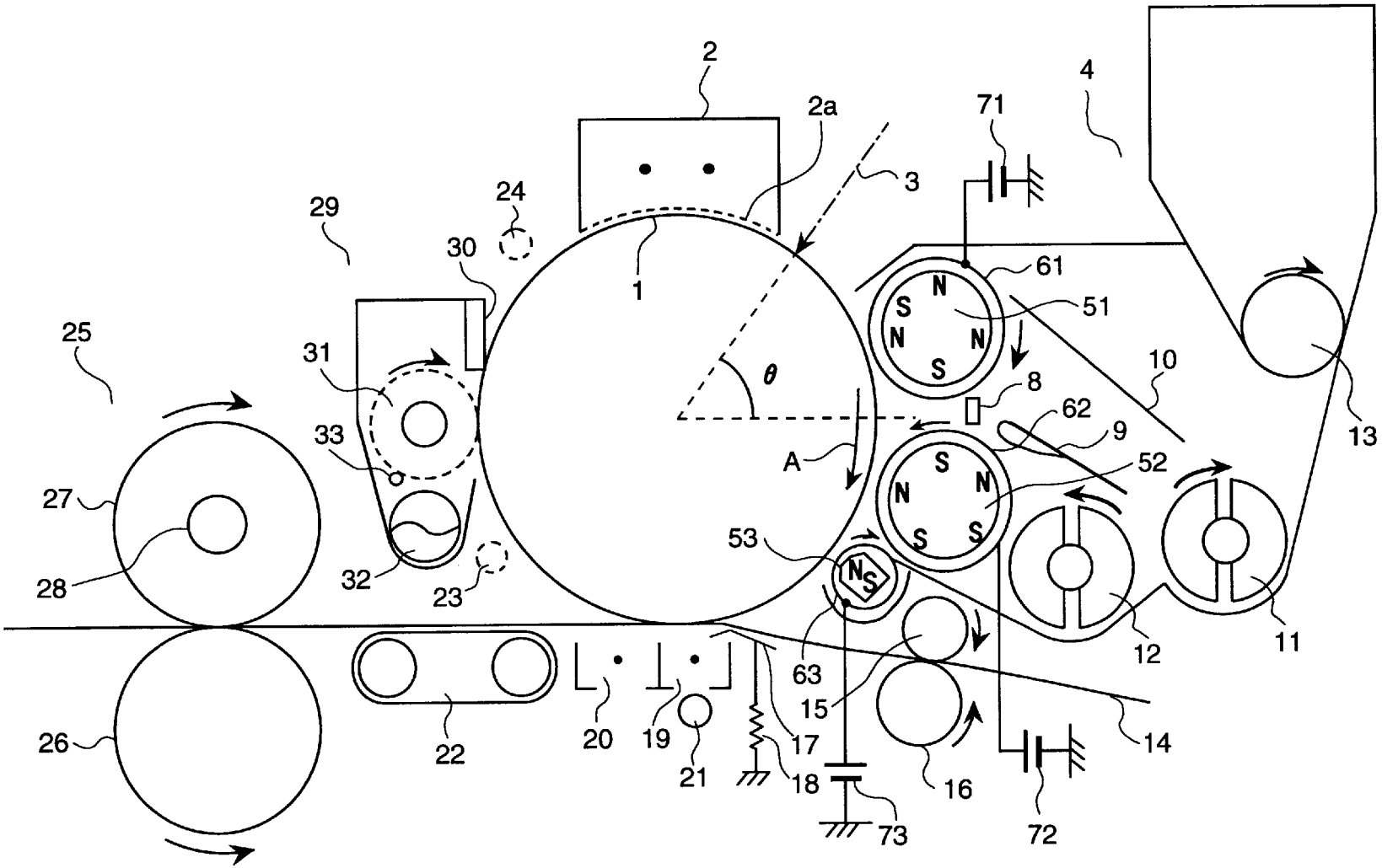
FIG. 1 is a diagram showing the construction of an embodiment of a laser printer in accordance with the present invention.

FIG. 1 is a view showing the construction of an embodiment of a laser printer in accordance with the present invention. As shown in the figure, a photosensitive drum 1 (hereinafter, referred to simply as a "drum") is rotated in a direction shown by an arrow A (clockwise), and around the drum 1 there are arranged a charger 2, a laser beam unit (an optical writing system) 3, a developing apparatus 4, a transferring unit 19 and a cleaner 29 in the order of the electrophotographic process. After uniformly charging the drum 1 using the charger 2, an electrostatic latent image is formed by the laser beam 3. Therein, the rotating speed (circumferential speed) of the drum 1 suitable for the present invention is 10 to 50 cm/s, preferably 20 to 40 cm/s. This is because an image fault appears at a speed as low as below 10 cm/s, and the developing ability exceeds its maximum ability at a speed as high as above 50 cm/s.

The diameter of the drum 1 is 40 to 150 mm. The diameter for realizing a high speed and small sized printer is 50 to 120 mm, and preferably 60 to 100 mm. The charging polarity can be either positive or negative, but the charging polarity in this embodiment is set to be positive. The charging voltage is 500 to 1000 V, for example, the drum is charged to 700 V. The exposing method is an image writing method, that is, an exposure of image portions.

An electrostatic charged image formed on the drum 1 is reversely developed by the developing apparatus 4 to form a toner image of positive polarity on the drum 1. Although it is possible to employ a background-lighting method as the exposing method and a normal developing method as the developing method, the present invention exerts its effect in a case of reverse development.

In the developing apparatus 4, a first developing roller 61 moved in a direction opposite to the moving direction of the drum 1 (from the point of view of the rotating directions, both are rotated clockwise, and accordingly both are rotated in "the same direction") and a second developing roller 62 moved in a direction equal to the moving direction of the drum 1 (from the point of view of the rotating directions, both are rotated in "the opposite direction" to each other) individually have magnets 51, 52 fixed inside, respectively. A two-component magnetic developing agent, having as main components a magnetic carrier and a (magnetic or non-magnetic) color toner, is attracted to the developing rollers 61, 62 by the magnetic forces of these magnets 51, 52, and further the two-component magnetic developing agent is respectively transferred by the first and the second developing rollers 61, 62 and brought in contact with the drum 1 to develop the above-mentioned latent image.

The magnetic density of a developing magnetic pole is 700 to 1200 Gausses, and the angles, not shown, of the center of the developing magnetic pole to a line connecting the center of the drum 1 and the center of the first and the second developing rollers 61, 62 are set to 0 to 10 degrees on the front side of the rotating direction in the first developing roller 61 and to ±10 degrees in the second developing roller 62. The charging polarity of the toner is positive, that is, the same as the charging polarity of the drum 1. The transferred quantity of the developing agent is adjusted by gaps between a regulating member 8 and the first and the second developing rollers 61, 62. The first developing roller 61 is connected to a bias power source 71 and the second developing roller 62 is connected to a bias power source 72. Both developing rollers are supplied with positive voltages which are the same polarity as the toner. When the charging voltage $V_0$ of the drum is, for example, 700 V, the bias voltages of 250 to 600 V are applied to the developing rollers. These bias voltages may be superposed on an alternating current voltage of 100 Hz to 10 kHz, and the effective voltage is ½ to ¼ of the direct current voltage.

The developing agent in the developing apparatus 4 is mixed right and left, back and forth using a pair of screw augers 11, 12 having cut portions. In the mixing, the screw augers 11, 12 have the effect of mixing and dispersing the toner into the developing agent and charging the toner compared to screw augers having a simple shape. Therefore, when the toner is supplied from a feed roller 13, the toner can be rapidly dispersed in the developing agent and charged up to a required charged amount in a short time, and accordingly it is possible to prevent the occurrence of fog in a non-image area or non-uniform development during the supply of toner.

The developing agent mixed as described above is attracted to and transferred by the second developing roller 62, and the developing agent which has passed through the gap between the regulating member 8 and the second developing roller 62 performs development of the latent image by the second developing roller 62 and then is returned into the developing apparatus 4. The developing agent restricted by the regulating member 8 goes toward the first developing roller 61 so as to be attracted to and transferred by the first developing roller 61. The developing agent which has passed through the gap between the regulating member 8 and the first developing roller 61 performs development of the latent image by the first developing roller 61 and then is returned into the developing apparatus 4 through operation of a scraper 10.

The surplus developing agent restricted by the second developing roller portion is returned to the screw auger portion by a guide plate 9. In a developing apparatus having a structure in which two developing rollers are vertically arranged as described above, the shape and the installed position of the guide plate 9 are also important. That is, it is necessary that the surplus developing agent restricted to be supplied to the second developing roller 62 is smoothly transferred to the first developing roller 61 by the regulating member 8, and that the force acting on the developing agent is small in order to reduce the load necessary for transferring the toner when the surplus developing agent restricted from being supplied to the first developing roller 61 by the regulating member 8 is returned. Therefore, it is preferable that the guide plate 9 has a bent portion in the front end thereof as shown in the figure to guide the surplus developing agent from the second developing roller 62 to the first developing roller 61, and the upper portion of the bent portion is positioned nearly in the middle of the two developing rollers, so that the shape of the bent portion can temporarily hold the developing agent on the upper portion.

Not only the toner, but also the carrier, is sometimes attached onto the drum 1 when developing is performed by the first and the second developing rollers 61, 62. In such a case, the carrier attached onto the drum 1 is attracted and returned by a catch roller 63 containing a fixed magnet 53, and is transferred back to the developing apparatus 4 by rotation of the catch roller 63.

In order to promote the transferring back of the carrier, the catch roller 63 is connected to a bias power source 73 having the same polarity as that of the charged voltage of the photosensitive body and is supplied with a voltage nearly equal to the charged voltage of the photosensitive body or the bias voltage of the second developing roller 62. Providing the catch roller 63 is effective for avoiding a fault in the transfer of the carrier or damage to the photosensitive body by the carrier attached on the drum 1, and also serves to prevent toner dispersion from the developing apparatus 4. However, in a case where two developing rollers 61, 62 are used in developing, as in the case of this embodiment, the second developing roller 62 has an effect of removing the attached carrier. Therefore, it is possible to use a plastic magnet as the magnet 53 or to use a small catch roller 63 having a diameter of nearly 10 mm. It is also possible to simply use a conductive roller without the magnet 53. In addition to this, when an alternating current voltage is superposed on the applied voltage similar to the case of the first and the second developing rollers 61, 62, the effect of removing the carrier can be increased.

In the above-mentioned construction of the developing apparatus 4, when the circumferential speed of the drum 1 is 20 to 40 cm/s and the diameter of the drum 1 is 60 to 100 mm, the diameter of the first and the second developing rollers 61, 62 suitable for obtaining a large developing capability in the small developing apparatus is ⅓ to ¼ of the diameter of the drum 1. For example, when the diameter of the drum 1 is 100 mm, it is preferable that the diameter of the first and the second developing rollers is 25 to 30 mm.

By setting the developing apparatus 4 at a position so that the angle between the exposing position of the laser beam 3 and the middle position of the developing rollers 61, 62 becomes an angle θ, that is, so that the moving time of the drum 1 corresponds to the photo-response time of the photosensitive body, it is possible to efficiently use the space so as to make the whole apparatus compact. The reason why the apparatus can be formed in such a way is that reverse development is employed.

The relationships among the rotating speeds (the circumferential speeds) of the two developing rollers 61, 62, the developing gaps, the applied bias voltages, the developing magnetic poles, the photosensitive body and the developing agent are to be described later. However, it is possible to obtain a uniform image without creating an unevenness from a low image density to a high image density by using an organic photosensitive body having a thick layer of 20 to 60 μm thickness and a semi-conductive developing agent, by setting the circumferential speed ratio of the first developing roller 61 to a small value equal to or smaller than that of the second developing roller 62, by setting the ratio of the sliding friction force between the magnetic brush of the developing agent formed in the first developing roller 61 and the drum 1 to the sliding friction force (brushing force) between the magnetic brush of the developing agent formed in the second developing roller 62 and the drum 1 within a range of 1 to 2, and by setting the bias voltage of the first developing roller 61 to a value within a range equal to the bias voltage of the second developing roller 62 to 70%. Further, in this embodiment, by employing reverse development, the life-time of the photosensitive body can be extended, since it is possible to prevent a toner filming phenomenon on the drum 1 due to the occurrence of a cleaning function during development of the first developing roller 61.

A printing paper sheet 14 is transferred by resist rollers 15, 16 and a paper guide plate 17 while the toner image on the drum 1 and the printing paper sheet 14 are being positioned, and the toner image is transferred onto the printing paper sheet 14 under action of a transferring unit 19. The paper guide plate 17 is connected to a ground resistor 18 having a resistance of 20 to 100 MΩ to prevent the necessary charge for transferring the toner image from leaking through the printing paper sheet under a high humidity condition.

A direct current high voltage of −4 to −7 kV is applied to the transferring unit 19, and the toner image on the drum 1 is electrostatically attracted onto the right side surface of the printing paper sheet 14 by applying a charge having a polarity opposite to the polarity of the toner onto the reverse side surface of the printing paper sheet 14. Then, as the drum 1 is rotated, the printing paper sheet 14 is pealed and separated from the photosensitive drum 1 while the charge produced by the charger (transferring unit) 19 is being discharged by a discharger 20 for facilitating the separation. An alternating current voltage having a frequency of 200 to 1000 Hz and an effective voltage of 4 to 6 kV superposed on a direct current voltage of 100 to 500 V is applied to the discharger 20 to generate an alternating current corona. During the toner transferring operation and the discharging operation described above, light is irradiated onto the drum 1 by an erasing lamp 21 placed on the back side of the transferring unit 19. By doing so, the charge on portions of the drum 1 between the printing paper sheets and corresponding to an end portion of the printing paper sheet is decayed. Further, part of charge on the drum 1 is discharged when a thin printing paper sheet is used since light is irradiated on the drum 1 through the thin paper sheet.

The decay of charge on the drum 1 is effective to reduce the electrostatic attracting force between the printing paper sheet 14 and the drum 1, so as to contribute to the separation of the printing paper sheet 14 from the drum 1. It is preferable to additionally use an erasing lamp 24 in order to eliminate any charge remaining on the drum 1 for preparing for the next image forming, and it is preferable to use an erasing lamp 23 in order to further reduce the electrostatic attracting force between the toner and the photosensitive body so as to improve the efficiency of removal of the remaining toner at a cleaner 29. In any case, the charging polarity by the transferring unit 19 is opposite to the charging polarity of the charger 2, that is, it is negative in the case of this embodiment where the charging polarity of the photosensitive body is positive, and therefore, there is a possibility that the photosensitive body may be charged in the opposite polarity, that is, negative. In such a case, the drum 1 cannot be discharged by any of the erasing lamps because the drum 1 does not usually have any sensitivity to the charged polarity. In such a case, since the surface voltage of the drum 1 before charging by the charger 2 is not uniform, it is necessary to use a charger 2 capable of controlling the charging voltage by means of a screen (grid) 2*a* placed near the surface of the drum 1, as shown in FIG. 1.

After the toner image has been transferred, the printing paper sheet 14 is passed through a transferring belt 22, and is heated and pressed by a fixing unit 25 to fix the toner image onto the printing paper sheet 14. The fixing unit 25 is composed of a heat roller 27 having, for example, a heater 28 therein and a back-up roller 26 pressed against the heat roller 27. Unnecessary toner remaining on the surface of the drum after transferring is removed by the cleaner 29 and is used for the next image forming.

The cleaner 29 is composed of a blade member 30, for example, such as a rubber plate, a brush 31 rotating while being in contact with the surface of the drum 1 and an cleaner ejector 32 for the ejecting removed toner.

In order to extend the life-time of the organic photosensitive body in a printer having such a construction, it is required that the film thickness is large, the electrophotographic characteristic is maintained, and the abrasion rate in contact with the blade member 30 is small. In order to satisfy these requirements, the film thickness should be 20 to 60 μm, preferably 25 to 50 μm. This thickness value is preferable from the viewpoint of fast and uniform charging of the organic photosensitive body having a dielectric constant of 3 to 5 using the charger 2 and from the viewpoint of suppressing image wane at the time of development, as well as from the view point of the abrasion and the electrophotographic characteristic.

Further, it is required that the quantity of the abrasion is 1 to 3 μm per $10^5$ rotations and good quality images are maintained for a long time period. In order to satisfy this requirement, it is necessary to use a toner having a small abrasion effect due to the contact with the blade member 30. However, if such a toner is used, the charging stability of the toner is decreased, and, as a result, it becomes difficult to obtain a toner having a long lifetime. On the other hand, it is also possible to suppress the abrasion rate to a small value by lowering the pushing pressure of the blade member 30 against the photosensitive body, but this results in problems of fog in the background area, black lines (streaks), photosensitive body filming and so on due to insufficient cleaning (slipping through).

The present invention prevents the occurrence of such problems. That is, a long life-time photosensitive drum, a long life-time developing agent and a long life-time cleaner are obtained without the occurrence of any image faults (fog in background area, black lines, wanes) and photosensitive body filming, though a good charging stability toner and a low pressure blade cleaner are used.

Figure 8:
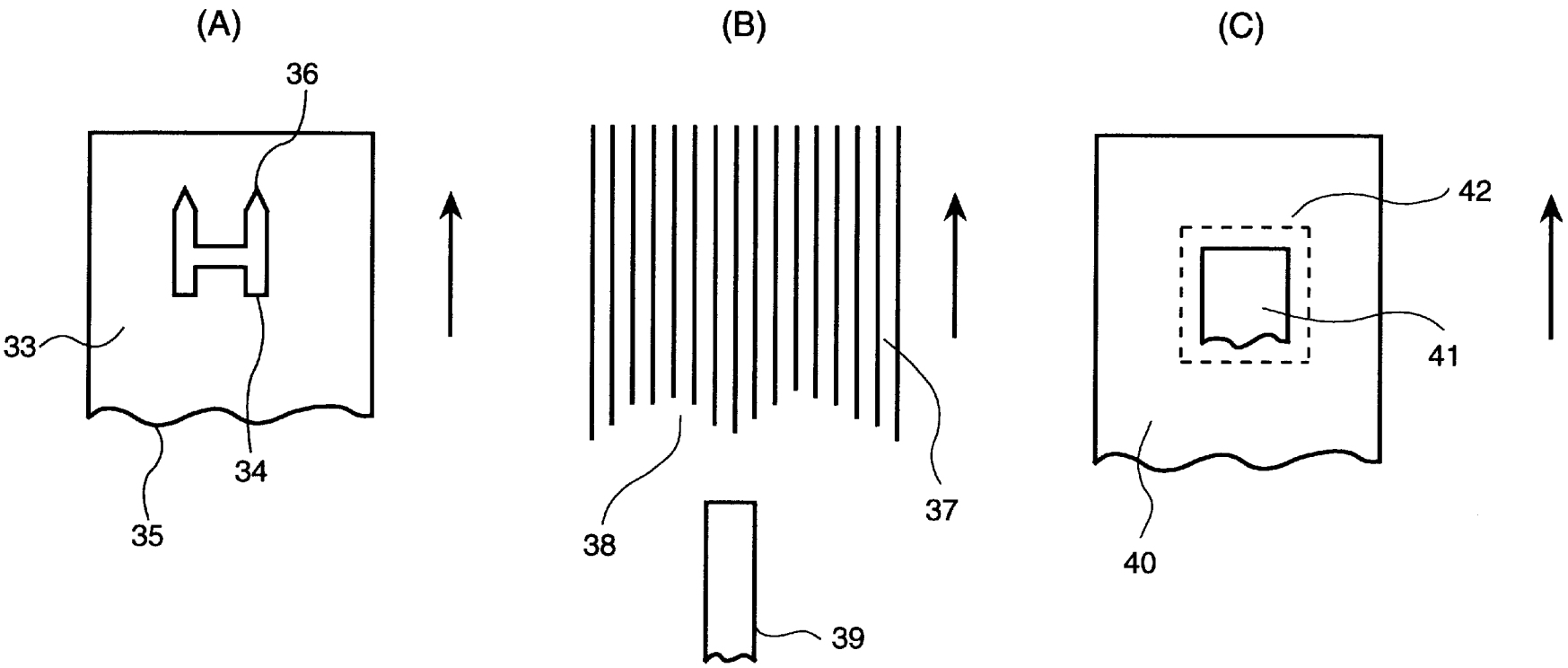
FIG.8 (PRIOR ART)
FIGS. 8(A) to 8(C) are diagrams showing examples of image faults in a conventional apparatus.

The image faults shown in FIG. 8 can be eliminated by using a low resistivity developing agent having a dynamic electric resistivity smaller than $10^6$ Ω·cm and by developing with two developing rollers 61, 62 rotating in directions different from each other, as shown in FIG. 1. However, there are problems in that the image faults cannot be completely eliminated in a low density image, the lifetime of the developing agent is short, the life-time of the photosensitive body is shortened by discharge between the photosensitive body and the developing rollers, and bias leakage is apt to occur. Further, there are problems in that a high image density cannot be obtained by a high resistivity developing agent, and defects in a half tone image of mesh, crosshatch or thin line structure cannot be eliminated. In an organic photosensitive material (dielectric material) having a dielectric constant of 3 to 5, the defects are apt to occur when the film thickness is below 20 μm. The present invention prevents the above-mentioned image faults and makes it possible to extend the life-times of the developing agent and the photosensitive body.

Firstly, when a specific dielectric constant of an organic photoconductor is within a range of 3 to 5, the film thickness of the organic photoconductor layer is set within a range of 20 to 60 μm, preferably 25 to 50 μm. This is because the life-time of the photosensitive body is extended by reducing the edge effect of the electric lines of force and by securing an allowance to the abrasion of the photosensitive body by the developing agent and the cleaner blade. When the thickness of the photosensitive body is below 20 μm, the edge effect is large, the above-mentioned image faults are apt to occur and the life-time of the photosensitive body is shortened. When the thickness of the photosensitive body exceeds 60 μm, the photo-response is decreased, the remaining voltage becomes large and the photosensitive body becomes difficult to manufacture. The problem of decrease in the photo-response and increase in the remaining voltage caused by the thick photosensitive layer can be solved by appropriately setting and adjusting the position θ of the developing apparatus 4 and the developing bias voltage.

In accordance with the present invention, the quantity of the abrasion becomes 1 to 3 μm per $10^5$ pages and the life-time of the drum 1 can be $2\times10^5$ to $10^6$ pages by combining the developing system and the cleaner in the manner described above and to be described below.

The carrier of the developing agent used is a ferrite or a magnetite carrier having a volume average grain size of 70 to 120 μm, preferably 80 to 100 μm. When the volume average grain size is below 70 μm, the quantity of the carrier attached to the photosensitive body is increased and the fluidity of the developing agent is reduced. When the volume average grain size is above 120 μm, the image density is decreased and the image is disturbed.

Among the carriers described above, carriers having a saturated magnetizing density within a range of 50 to 100 emu/g (external magnetic field of 3000 Oersted) can be used. When the saturated magnetizing density is below 50 emu/g, the developing agent is difficult to transfer. When the saturated magnetizing density is above 100 emu/g, the rigidity of the developing brush becomes large, thereby degrading the image quality. An intensity suitable for the magnetic flux density of the developing magnetic pole is 700 to 900 Gausses. Further, when water soluble ions are attached to the surface of the carrier, it is preferable to use a carrier which is rinsed and dried after use, since the charging quantity change of the toner over time is large relative to the number of printings during the initial stage of use of the developing agent.

The toner used is a toner containing a resin, a coloring material, a charging control material and so on and having a volume average grain size of 5 to 12 μm, preferably 8 to 10 μm. When the volume average grain size is below 5 μm, the toner is difficult to manufacture and the fluidity of the developing agent is decreased. On the other hand, when the volume average grain size is above 12 μm, the resolution is lowered and, consequently, it becomes difficult to obtain a high resolution print above 16 lines per mm. As the resin, styrene, acrylic acid resin, butadiene, co-polymer of styrene acrylic acid resin, polyester or the like may be used. However, a co-polymer of styrene acrylic acid resin is suitable because with this resin the charging control is comparatively easy.

The cover ratio, covering the carrier with a toner, is set to 0.2 to 0.5, preferably 0.25 to 0.4. When the cover ratio is below 0.2, the quantity of toner supply becomes short and a high density image cannot be obtained. On the other hand, when the cover ratio exceeds 0.5, problems, such as a decrease in the charging build-up speed, fog in the background area, and toner dispersion, are apt to occur.

The quantity of charge of the toner is preferably 10 to 25 μC/g (the quantity of charge of the toner developed on the photosensitive body is measured). For example, in a case of a toner grain size of 8 to 10 μm, a good image can be obtained when the quantity of the charge of the toner is 15 to 20 μC/g. When the quantity of charge of the toner is below 10 μC/g, an excessive quantity of toner attaches to the drum and the toner is dispersed. On the other hand, when the quantity of charge of the toner is above 25 μC/g, the image density becomes small.

In order to maintain such a quantity of charge during a long time period of printing ($2\times10^5$ to $10^6$ pages), it is preferable that conductive magnetic fine $Fe_3O_4$ particles (magnetite, 50 to 100 emu/g, external magnetic field 1000 to 3000 Oersteds) are added onto the toner surface or inside the toner. That is, in order to perform high speed development using a quantity of the developing agent as small as 1 to 2 kg in the present construction of the developing apparatus, it is preferable that the developing agent is moderately mixed to suppress the load on the developing agent, and the rotating speed of the developing rollers is suppressed to as low a value as possible to prevent the occurrence of image faults due to the developing direction, as will be described with reference to FIG. 8. Therefore, it is necessary that the toner as the developing agent is charged up fast when the toner is fed into the developing apparatus and the charge amount is maintained constant without being increased. By conducting various tests in order to obtain this characteristic, it has been found that magnetite having a grain size within the range of 0.05 to 2 μm, preferably 0.2 to 0.7 μm, should be added in an amount of 0.1 to 2 wt % to the toner surface or 0.5 to 20 wt % inside the toner.

The developing agent has attained a life-time of $2\times10^5$ to $5\times10^5$ pages per 1 kg. When the grain size is smaller than the above range or the adding range is less than the above range, the charge build-up is slow and the change in the charge quantity becomes large. On the other hand, when the grain size is larger than the above range, there are problems in that a quantity of the abrasion of the photosensitive body by the blade becomes large as well as the change in the charge quantity becomes large.

When the quantity of the added magnetite is too much, the quantity of charge becomes small and the quantity of the abrasion of the photosensitive body becomes too large to be used. In a case where the quantity of the added magnetite is within the above-described range, it is possible to bring the quantity of the abrasion of the organic photoconductor to 3 to 10 μm per $3\times10^5$ rotations, and accordingly, it is possible that the photosensitive body can attain a life-time of $2\times10^5$ to $10\times10^5$ rotations. Therein, it may be possible to add $SiO_2$ (silica) or $TiO_2$ (titanium oxide) in the amount of 0.1 to 0.5 wt % together with magnetic powder to the toner.

The dynamic electric resistivity of the developing agent suitable for the present invention is within the range of $10^8$ to $10^{11}$ Ω·cm, and at that time the dynamic electric resistivity of the carrier is within the range of $10^7$ to $10^{10}$ Ω·cm. Therein, the dynamic electric resistivity is a value calculated from a current which is obtained by using a metal drum, for example, an aluminum drum, instead of the drum 1, and applying a direct current voltage of 100 V under a condition of transferring the developing agent or the carrier by the developing rollers 61, 62, and a gap, a contact width and a contact length.

There is a developing gap appropriate for the dynamic electric resistivity, as will be described later with reference to FIG. 5. However, when the dynamic electric resistivity is below the above-mentioned range, there occur troubles, such as damage of the photosensitive body by discharge, bias leakage, a decrease in the life-time of the developing agent (increase in the resistivity change due to the spent toner) and so on. When the dynamic electric resistivity is above the above-mentioned range, a shortage of the image density occurs.

Description will be made on a result of studying the rotating speeds of the developing rollers capable of suppressing occurrence of the image faults described with reference to FIG. 8 in a case where the photosensitive body and the developing agent described above are used.

The rotating speeds of the developing rollers capable of suppressing the occurrence of image faults have been studied relative to the relationship between a circumferential speed ratio S1=Vd1/Vp of a circumferential speed Vd1 of the first developing roller 61 to a circumferential speed Vp of the photosensitive body 1 and a circumferential speed ratio S2=Vd2/Vp of a circumferential speed Vd2 of the second developing roller 62 to the circumferential speed Vp of the photosensitive body 1. The directions of the circumferential speed ratios S1, S2 and the moving direction of the photosensitive body 1 are set according to the direction of the arrow shown in FIG. 1 as (+).

In order to prevent the image faults due to the moving directions of the developing agent in the case where development is performed by two developing rollers 61, 62 rotated in directions opposite to each other, it is preferable that the relative speeds to the speed of the drum 1 are set to opposite directions relative to each other, that is, S1>0 and S2>1 so as to compensate a portion where an image fault occurs by the first developing roller 61 using the second developing roller 62. FIG. 2 shows various examples of an allowable range of the circumferential speed ratios S1 and S2 which have been experimentally confirmed.

In this experiment, in order to make it easy to judge the image faults, the developing bias voltage is set to a value so that the image density D of the solid black portion becomes 1.1 in which the image density is slightly light.

The experimental conditions are as follows.

S1: 1.5

Diameter of the photosensitive body: 100 mm

Thickness of the organic photoconductor: 30 $\mu$m

Specific dielectric constant: approximately 3

Circumferential speed of the photosensitive drum Vp: 250 mm/s

Diameters of the first and the second developing rollers: 30 mm

Magnetic densities of the developing magnetic poles of the first and the second developing rollers: 900 Gausses Angle between the first developing roller and the photosensitive drum: 50°

Angle between the second developing roller and the photosensitive drum: 0°

Charged voltage $V_0$ of the photosensitive drum: 650 V

Bias voltage b1 of the first developing roller: 300 V

Bias voltage b2 of the second developing roller: 350 V

Developing agent carrier:

Magnetite

Volume average grain size 100 $\mu$m

Saturation magnetizing density 90 emu/g

Dynamic electric resistivity $1.5\times10^8$ Ω·cm

Developing agent toner:

Volume average grain size 9 $\mu$m

Quantity of charge 15 $\mu$C/g

Developing agent:

Toner coverage 0.3

Dynamic electric resistivity $1.2\times10^{10}$ Ω·cm

Filling density of the developing agent at the developing portion of the first developing roller: 41%

Filling density of the developing agent at the developing portion of the second developing roller: 35%

Images are formed under the above-mentioned experimental conditions, and evaluated for waning of a front end of a solid black portion (refer to FIG. 8(A)), waning of a rear end of a solid black portion (refer to FIG. 8(A)), a front end of a white hollow portion (refer to FIG. 8(A)), a rear end of a white hollow portion (refer to FIG. 8(A)), a thin line strip (refer to FIG. 8(B)), a front end of a solid black portion in a cross hatch area (FIG. 8(C)) and a rear end of a solid black portion in a cross hatch area (FIG. 8(C)). The evaluated results are shown in FIG. 2 wherein an excellent image is indicated by mark O, a fair image is indicated by mark Δ and a bad image is indicated by mark x.

It can be understood from the evaluation result that the range of S2 capable of obtaining an allowable image to S1=1.5 is $1.5 \leqq S2 \leqq 3.5$, preferably $2 \leqq S2 \leqq 3$. That is, the range of S2 capable of obtaining an allowable image is S2=(S1+1)±0.5.

It has been confirmed from an experiment that when the circumferential speed of the drum 1 is set to 20 to 40 cm/s, a compatible condition of the excellent range obtained under the various experimental conditions with a range of the developing rollers having a sufficient developing capability and at the same time capable of suppressing the load due to rotation to as small a value as possible is within the range of $0.5 \leqq S1 \leqq 2.5$ and $1.5 \leqq S2 \leqq 3.5$, preferably $0.5 \leqq S1 \leqq 2$ and $1.5 \leqq S2 \leqq 2.5$.

Figures 3, 4:
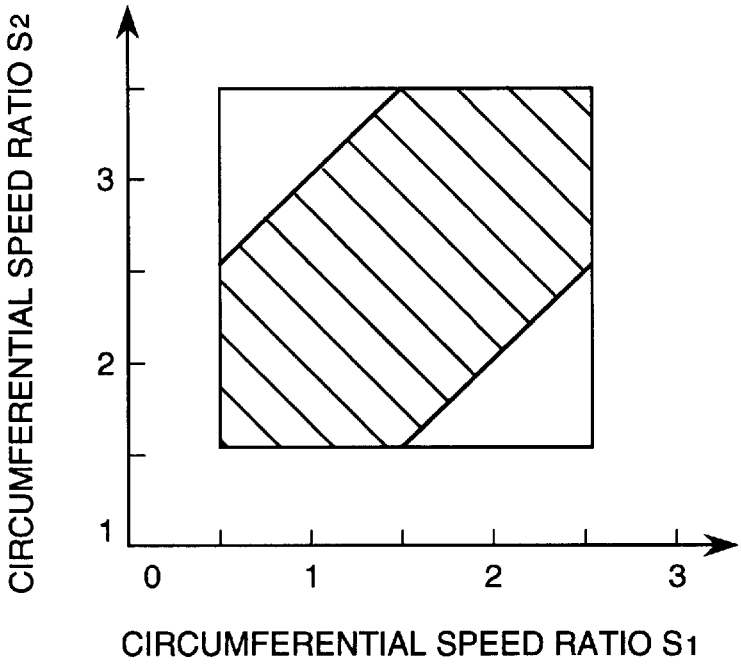
FIG. 3 is a characteristic diagram showing a preferable zone of the circumferential speed ratios S1 and S2 in the laser printer of FIG. 1.
FIG. 4 is a characteristic table summarizing evaluated results of the ratio (F1/F2) of sliding friction force (brushing force) F1 of the first developing roller against the photosensitive drum and sliding friction force F2 of the second developing roller against the photosensitive drum, and other characteristics in the laser printer of FIG. 1.

Further, when the above relationship is added to a relationship capable of bringing about a cleaning effect by setting a sliding friction force in the first developing roller 61 equal to or larger than that of the second developing roller 62 through deferring the relative speeds, that is, the condition that a difference of the circumferential speed ratio of the first developing roller 61 to the drum 1 is larger than a difference of the circumferential speed ratio of the second developing roller 62 to the drum 1 ($S1+1 \geqq S2-1$) and the condition that the circumferential speed ratio of the second developing roller 62 is set equal to or larger than that of the first developing roller 61 ($S1 \leqq S2$) in order to increase the developing capability of the second developing roller 62 rotating in the same direction as that of the drum 1 by increasing the toner transferring capacity, a hatched zone shown in FIG. 3 can be obtained. A rectangular zone in the figure corresponds to the zone $0.5 \leqq S1 \leqq 2.5$ and $1.5 \leqq S2 \leqq 3.5$.

On the other hand, increasing the sliding friction force of the magnetic brush in order to provide the cleaning effect in the first developing roller 61 or an appropriate abrasion effect to the drum 1 is useful for preventing filming on the drum 1 and for suppressing fog in the background area. However, when the sliding friction force is too large, an unbalance will sometimes occur in the image faults or excessive abrasion of the drum 1 will occur. The sliding friction force can be changed by varying the difference in the relative speeds or the developing agent density in the developing region.

FIG. 4 shows an example of an experimental result of a study of these relationships. In this experiment, the sliding friction force is changed by varying the developing agent density in the developing region. The sliding friction force can be obtained by attaching a torque meter to the drum 1 and measuring the change in the rotating force of the drum 1 when the first developing roller 61 or the second developing roller 62 is operated. The sliding friction force is expressed on the basis of unit length of the magnetic brush.

In this experiment, the experimental conditions are such that S1 is set to 1.5, S2 is set to 2 and the sliding friction force F2 of the second developing roller 62 is set to 7.33 gf/cm (the filling density to 35%), and the other conditions are set to the same values as in the experiment of FIG. 2. It is clear from the figure that the ratio (F1/F2) of a sliding friction force F1 of the first developing roller 61 to a sliding friction force F2 of the second developing roller 62 is preferably set within a range of 0.9 to 2.1, particularly 1.2 to 1.6.

Figure 5:
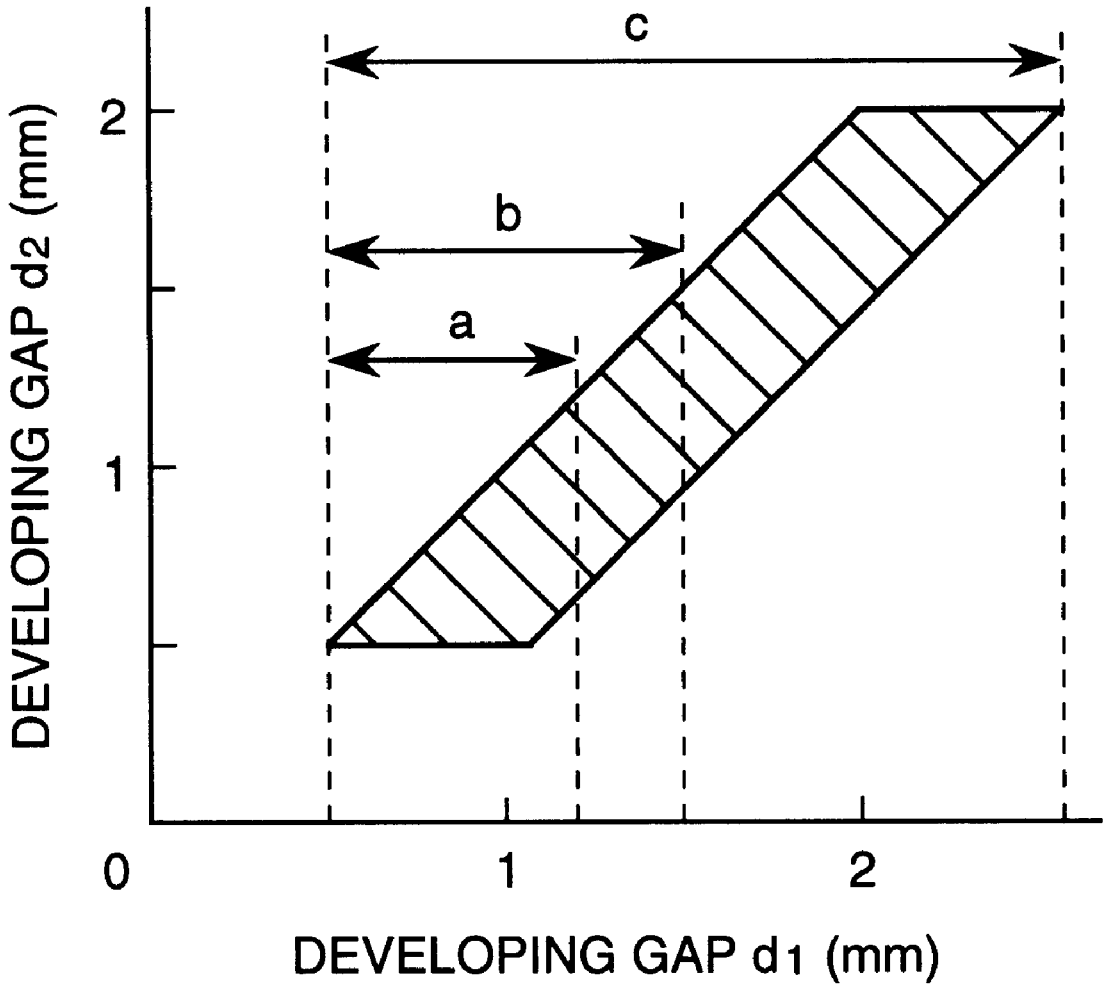
FIG. 5 is a characteristic diagram showing a preferable zone of the gap between the two developing rollers and the photosensitive drum in the laser printer of FIG. 1.

FIG. 5 shows the relationship between gaps of the two developing rollers relative to the drum. The gap d1 of the first developing roller 61 is set to a value equal to the gap d2 of the second developing roller 62 or wider than the gap d2 by 0.1 to 0.5 mm as shown in the figure (wider than the gap d2 by 0.5 mm in FIG. 5). This difference is caused by easiness of the developing agent flow due to the difference in the moving direction to the drum 1. The hatched zone in FIG. 5 shows the appropriate zone.

Further, if the second developing roller 62 is positioned accurately (for example, ±0.05 mm) during the set-up of the developing apparatus 4, the positioning accuracy of the first developing roller 61 may be degraded (for example, ±0.1 mm). Referring to the figure, the reference character a indicates a range where fringe can be easily prevented, the reference character b indicates a range where high image density can be easily secured, and the reference character c indicates a range where waning in an end portion can be suppressed. When the gap is smaller than 5 mm, it is difficult to transfer the toner stably. Therefore, it is preferable that both d1 and d2 are set within a range of 0.5 to 1.5 mm.

Although the developing gap has been taken into consideration as an index, it is preferable to take into consideration the filling density of the developing agent or the carrier at the developing gap portion. That is, when the gap is set to the same value as in the case of FIG. 3, the filling density of the carrier in the first developing roller 61 is set within a range of the same value to 1.5 times the filling density in the second developing roller 62. By doing so, the developing capability, the sliding friction force and the cleaning effect in the first developing roller 61 can be secured. In more detail, the filling density of the carrier in the first developing roller 61 is set to 30 to 60%, and the filling density of the carrier in the second developing roller 62 is set to 15 to 50%.

Figure 6:
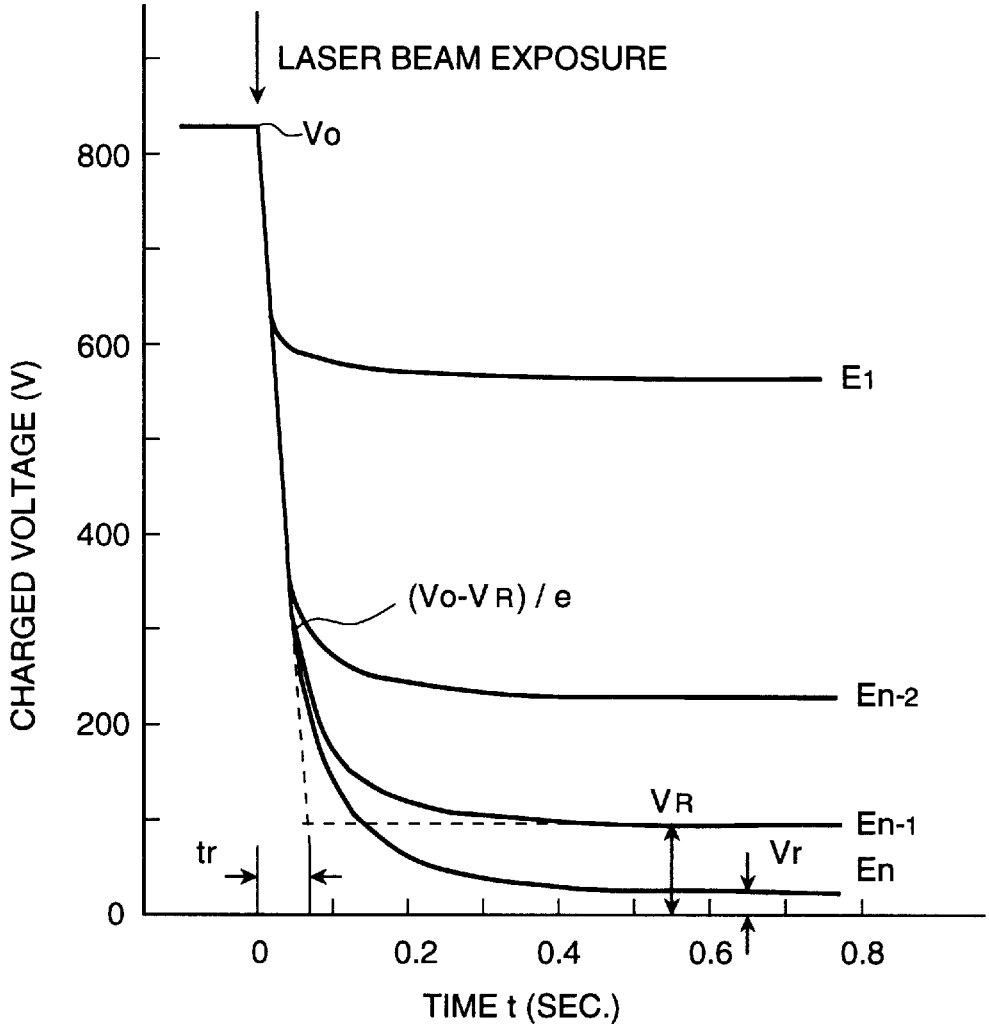
FIG. 6 is a characteristic diagram showing a photo-response characteristic of the photosensitive body and set position of the developing apparatus.

FIG. 6 is a characteristic diagram showing the relationship between a photo-response characteristic of the photosensitive drum and a set position of the two-roller developing apparatus. FIG. 6 shows a photo-response characteristic of an organic photosensitive body suitable for use in accordance with the present invention. The time t along the abscissa indicates the moving time of the photosensitive drum, that is, the elapsed time from the time when the photosensitive body is exposed at the exposing point. After the photosensitive body is exposed by scanning of a laser beam at the time t=0, the charged voltage decays and reaches a constant value (residual value) corresponding to a quantity of the exposed light as time elapses. On the other hand, when the quantity of the exposed light is increased as $E_1$, $E_2$, $E_3$ . . . $E_n$, the residual value reaches a value which does not decrease further. The residual voltage $V_r$ in that case is a so-called saturated residual voltage. In general, the quantity of the exposed light is set to a value within a range in which a contrast voltage of 80 to 100% of $(V_0-V_r)$ is obtainable, and a time period until the charged voltage decays to 90 to 100% of the value is kept as a time period before starting the development. However, keeping this time period means keeping a large distance from a position of exposure to a position of developing, and accordingly, the diameter of the photosensitive drum needs to be increased, causing an increase in the size and cost of the apparatus. Otherwise, the circumferential speed of the photosensitive drum needs to be slowed down to limit the high speed printing.

Referring to FIG. 6, time $t_r$ corresponding to an intersecting point of the extension of a portion of $V_0$ nearly linearly decaying with time (an extension of a line connecting between $V_0$ and $(V_0-V_R)/e$ (where e=2.718)) and a tangent of a portion of a residual voltage $V_R$ (a saturation residual voltage or a value near the saturation residual voltage) to an quantity of set light (in the figure, $E_{n-1}$) is set as the photo-response time. In a printing apparatus combining an organic photosensitive body and a blade cleaner, abrasion of the photosensitive material layer of the photosensitive body is 0.1 to 1 $\mu$m per $10^4$ print pages. When the photosensitive layer is formed so as to have a thickness above 25 $\mu$m, preferably 30 to 60 $\mu$m, in order to obtain a long life-time photosensitive body, the photo-response characteristic is degraded and accordingly the photo-response time $t_r$ becomes large.

Further, when the temperature of the environment in which the apparatus is used is low (lower than 15° C., particularly lower than 10° C.) or when the humidity of the environment in which the apparatus is used is low (lower than 50%, particularly lower than 30%) depending on the photosensitive body used, the photo-response characteristic is degraded. For example, the photo-response time $t_r$ becomes 0.1 second to 0.3 second, which leads to a problem of mounting the apparatus.

The present invention is able to realize a high speed and small sized printing apparatus using a photosensitive body having a long photo-response time, and is capable of setting a short distance between the exposing position of the laser beam 3 and the first developing roller 61. That is, the time from exposure of the laser light to reaching the point between the first developing roller 61 and the second developing roller 62 (the angle θ) is set so as to become $t_r$. Particularly, it is preferable to cause the angle θ to correspond the photo-response time $t_r$ at a low temperature and low humidity condition. Since by doing so the first developing roller 61 can be arranged near the exposing portion, it is very effective in order to obtain an apparatus combining a photosensitive drum having a small diameter and two developing rollers in a high speed printing condition.

Since in the developing roller 61 a reverse development is performed under a condition where the voltage of the photosensitive body is still higher than a desired value, it is important during high speed printing to increase the developing efficiency. This disadvantage can be compensated in a case of reversing development using the developing apparatus in accordance with the present invention in which the first developing roller is rotated in the same direction as the rotating direction of the photosensitive body and the second developing roller is rotated in the opposite direction. In other words, in a case where the photosensitive body and the developing roller are rotated in the same direction (the developing agent and the photosensitive body in the developing region are moved in the directions opposite to each other), the developing capability is better and the fog in the background area is less as compared to a case where the photosensitive body and the developing roller are rotated in opposite directions relative to each other. On the other hand, in the development produced by the second developing roller, which is rotated in the opposite direction, the image becomes smooth and uniform. In the developing apparatus in accordance with the present invention, the above-mentioned problem concerning the residual voltage can be reduced since the developing apparatus in accordance with the present invention has a better developing efficiency and is capable of uniform developing.

Further, in the case of reverse development, the bias voltage applied to the first developing roller is set to a value equal to or higher than the bias voltage applied to the second developing roller. For example, setting the bias voltage applied to the first developing roller higher than the bias voltage applied to the second developing roller by 20 to 100 V, the developing capability can be increased. Therefore, by employing this method, it is also possible to eliminate the disadvantage of setting the photo-response time $t_r$ between the two developing rollers.

Figure 7:
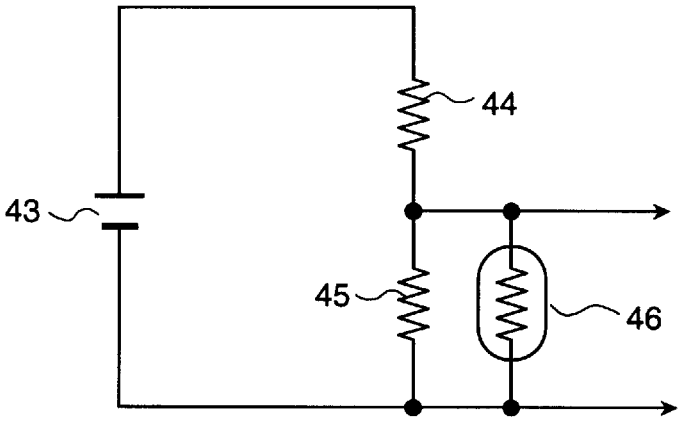
FIG. 7 is a schematic diagram showing a bias applying circuit in the laser printer of FIG. 1.

When the thickness of the photo-conductor layer is increased, there occurs a problem in that the image density is decreased since the residual voltage (charged voltage after exposure) becomes large at a low temperature condition. Therefore, the following method is employed in the present invention. FIG. 7 is a diagram showing a bias applying circuit for the purpose.

A resistor 44 and a thermistor 46 are connected with a developing bias power source 43 in series, and a resistor 45 is connected to the thermistor 46 in parallel. The resistor 45 may be omitted in some cases. A voltage generated in the thermistor 46 is applied to the two developing rollers 61, 62. Therein, the thermistor 46 is mounted so as to be in contact with a portion near the developing apparatus 4, with the developing apparatus 4 or with part of the flow of the developing agent. Thereby, the resistance of the thermistor changes depending on the temperature of the developing agent.

The temperature of the photosensitive drum 1 becomes near the temperature of the developing agent during operation of the printer. Therefore, when the temperature decreases, the bias voltage is increased and operates so as to compensate for a decrease in the image density. By employing a construction having the thermistor 46 integrally attached to the developing apparatus 4, it is possible to provide a developing apparatus unit which can automatically compensate for a residual voltage change due to a temperature change of the photosensitive drum 1.

Further, few image faults occur, so that a uniform and high quality image can be obtained in the developing apparatus having the two developing rollers in accordance with the present invention, as described above, except for the cleaning effect in the first developing roller 61 on the remaining toner on the photosensitive body before developing. Therefore, by employing the cleaning capability of the cleaner 29, it is possible to attain a blade member having a long life-time and the photosensitive body will have a long life-time and experience a reduction of abrasion without the occurrence of troubles, such as fog in the background area, toner filming on the photosensitive body and so on.

Since it is preferable that the toner used in the developing apparatus in accordance with the present invention has a magnetic powder added thereto, the organic photoconductor layer is easily ground by the cleaner blade portion. In order to prevent the organic photoconductor layer from being ground, it is preferable to reduce the pushing pressure of the blade. However, if the pushing pressure of the blade is low, the attached toner cannot be removed and remains. The limit of the pushing pressure of the blade is an amount in response to which the remaining toner does not exceed a visible limit of fog in the background area or does not accumulate so as to fix onto and form a film on the surface of the photosensitive body.

It has been clarified from studying this condition that the fog in the background area and the filming formation due to the cleaning operation in the developing roller of the developing apparatus, particularly, the first developing roller 61 can be prevented if the number of toner particles remaining after cleaning is approximately 100 to 1000 particles/$cm^2$ when the quantity of the toner before cleaning is within a range of 0.5 to 1 mg/$cm^2$. Further, it has been confirmed that the above condition does not interrupt the exposure. A quantity of toner of 0.5 to 1 mg/$cm^2$ before cleaning represents a case where a toner image formed by development reaches the cleaner portion without being transferred. Such a case corresponds to a case where a patch image for detecting an image density is formed between paper sheets when a problem in paper transmission occurs. Since a developed toner image is transferred to a paper sheet at the time of actual printing, there is no trouble even if the cleaning efficiency is not so good. However, if such a performance is secured, no problem occurs when an image is formed fully over a paper sheet or when the image extends out of the paper sheet or when patch images for detecting image density are formed continuously or without stopping the actual printing operation. The cleaning performance must be secured at the end of the life-time of the blade.

On the other hand, the relationship among the cleaning performance, the quantity of abrasion of the organic photosensitive body (OPC) and the life-time of the blade has been studied. An experiment was conducted using a toner having a magnetic powder added onto the surfaces of the toner (an average volume toner grain size of 8 $\mu$m, an average volume magnetic powder grain size of 0.4 $\mu$m, a quantity of additive of 0.5 wt %), a photosensitive body having a diameter of 100 mm (composition of the binder: polycarbonate resin having a molecular weight of approximately $10^5$), and a counter-contact type blade made of a commonly used urethane rubber having a rubber hardness of 70±5 degrees, a thickness of 2 mm and a free-end length of 12 mm, under the condition of a quantity of toner before cleaning of 0.8 mg/$cm^2$. In order to suppress the amount of toner remaining after cleaning below 100 particles/$cm^2$, it was necessary to set the blade linear pressure above 15 g/cm. In that case, the quantity of abrasion of the OPC was approximately 5 $\mu$m per $10^5$ rotations, and the life-time of the blade was below $10^5$ rotations.

In order to suppress the amount of toner remaining below 1000 particles/$cm^2$, it was necessary to set the blade linear pressure above 5 g/cm. In that case, the quantity of abrasion of the OPC was below 1 $\mu$m per $10^5$ rotations, and the life-time of the blade was below $3\times10^5$ rotations. Similarly, a test was conducted by changing the magnetic powder of the toner within the above-mentioned range. The result revealed that in order to make the amount of abrasion within the range of 1 to 3 $\mu$m per $10^5$ rotations while securing the above-mentioned cleaning performance, it was necessary to set the blade linear pressure within a range of 5 to 15 g/cm, preferably 8 to 12 g/cm, and the life-time of the blade became not shorter than the lifetime of the drum.

A description will be made concerning a condition of the developing bias to make the remaining toner removing effect compatible with the developing capability in the developing apparatus. The effect of removing the remaining toner after cleaning becomes larger, as the difference between the bias voltage Vb1 applied to the first developing roller 61 and the charged voltage $V_0$ to the photosensitive body becomes larger. This is because a force acting on the toner on the photosensitive body from the photosensitive body to the developing roller side becomes larger.

However, when the difference becomes too large, the developing ability is decreased. Since the moving direction of the first developing roller 61 is opposite to the moving direction of the photosensitive body 1, the cleaning action and the developing action of the first developing roller 61 become larger than those of the second developing roller 62. Therefore, the voltage difference can be set relatively large.

It was revealed that the remaining toner can be taken back to the side of the first developing roller 61 to prevent the occurrence of fog in the background area and the filming of the OPC when the remaining toner is approximately 100 to 1000 particles/$cm^2$, and a bias voltage Vb1 capable of securing a practical developing ability is about ⅓ (about 35%) to ⅔ (about 70%) of the charged voltage $V_0$ of the photosensitive body when the charged voltage $V_0$ is 500 to 1000 V. It is possible to obtain a necessary image density and a uniform image by applying a bias voltage Vb2 to the second developing roller 62 which is not lower than the bias voltage of the first developing roller. The reproducibility of a thin line can be brought within a range allowable for widening or thinning of a line due to light distribution of the laser spot when ($V_0$−Vb) is within a range of ⅓ to ½. Therefore, it is preferable that the bias voltage Vb2 of the second developing roller 62 satisfies at least the above condition.

A further preferable method in regard to a bias voltage applied to the developing rollers is that the bias voltage applied to at least one of the first and the second developing rollers, preferably the first developing roller 61, more preferably both rollers, is set to a voltage lower than the bias voltage during normal printing when the printer is in an initializing state at the start of a printer operation, at the start of a printing job or when restarting printing after printing has been stopped due to a paper jam or the like. By doing so, it is possible to remove the remaining toner or dirt quickly and efficiently.

As has been described above, the present invention can provide an electrophotographic apparatus which is capable of preventing unevenness in the developing due to the moving direction of the developing brush and forming an image having a good image quality even in a case of reproducing a halftone image having an image density D≦1.0 or composed of crosshatch or lines, since the moving direction of the first developing roller is opposite to the moving direction of the photosensitive body, and a circumferential speed ratio (S1=Vd1/Vp) of a circumferential speed (Vd1) of the first developing roller to a circumferential speed (Vp) of the photosensitive body is restricted in a range of 0.5 to 2.5; and the moving direction of the second developing roller is equal to the moving direction of the photosensitive body, and a circumferential speed ratio (S2=Vd2/Vp) of a circumferential speed (Vd2) of the second developing roller to a circumferential speed (Vp) of the photosensitive body is restricted in a range of 1.5 to 3.5.

Further, the present invention can provide a small sized electrophotographic apparatus which is capable of performing high speed printing without increasing the diameter of the photoconductor photosensitive body, since the time required for rotating said photosensitive body from an exposing position of the exposing means to a position between the first developing roller and the second developing roller corresponds to a photo-response time of the photosensitive body.

Furthermore, the present invention can extend the lifetimes of the photosensitive body and the cleaner blade member, since the contact pressure of the cleaner blade member against the photosensitive body can be reduced to a low pressure.

What is claimed is:

1. An electrophotographic apparatus forming a latent image on a photosensitive body by exposing said photosensitive body using an exposing means, and developing said latent image by a two-component magnetic developing agent having a magnetic carrier and a toner as main components using a first developing roller and a second developing roller rotated in directions opposite to each other and arranged along a moving direction of said photosensitive body, wherein the moving direction of said first developing roller is opposite to the moving direction of said photosensitive body, and a circumferential speed ratio (S1=Vd1/Vp) of a circumferential speed (Vd1) of the first developing roller to a circumferential speed (Vp) of the photosensitive body is restricted in a range of 0.5 to 2.5; and the moving direction of said second developing roller is equal to the moving direction of said photosensitive body, and a circumferential speed ratio (S2=Vd2/Vp) of a circumferential speed (Vd2) of the second developing roller to the circumferential speed (Vp) of the photosensitive body is restricted in a range of 1.5 to 3.5.

2. An electrophotographic apparatus according to claim 1, wherein said circumferential speed ratio (S1) of the first developing roller is smaller than the circumferential speed ratio (S2) of the second developing roller (S1≦S2).

3. An electrophotographic apparatus according to any one of claim 1 and claim 2, wherein a ratio (F1/F2) of a sliding friction force (F1) between a magnetic brush for developing agent and the photosensitive body formed at said first developing roller and a sliding friction force (F2) between a magnetic brush for developing agent and the photosensitive body formed at said second developing roller is restricted within a range of 0.9 to 2.1.

4. An electrophotographic apparatus according to claim 1, wherein said photosensitive body is made of an organic photoconductor layer, a specific dielectric constant of said organic photoconductor layer being restricted within a range of 3 to 5, a film thickness of said organic photoconductor layer being restricted within a range of 20 to 60 μm.

5. An electrophotographic apparatus according to claim 1, wherein a dynamic electric resistivity of said megnetic carrier is restricted within a range of $10^7$ to $10^{10}$ Ω·cm and a dynamic electric resistivity of said developing agent is restricted within a range of $10^8$ to $10^{11}$ Ω·cm.

6. An electrophotographic apparatus comprising a developing means for forming a toner image on a photosensitive body by forming a latent image combining exposed portions and non-exposed portions on said photosensitive body by exposing said charged photosensitive body using an exposing means, and developing said exposed portions by a developing agent having a magnetic carrier and a toner containing magnetite fine particles as main components using a first developing roller and a second developing roller rotated in directions opposite to each other and arranged along a moving direction of said photosensitive body;

developing means for forming a toner image on said photosensitive body; and a cleaning means having a blade member for removing toner remaining on the photosensitive body after transferring said toner image to printing paper, said blade member being provided so as to push against a surface of said photosensitive body; wherein the moving direction of said first developing roller is opposite to the moving direction of said photosensitive body, and a circumferential speed ratio (S1=Vd1/Vp) of a circumferential speed (Vd1) of the first developing roller to a circumferential speed (vp) of the photosensitive body is restricted in a range of 0.5 to 2.5;

the moving direction of said second developing roller is equal to the moving direction of said photosensitive body, and a circumferential speed ratio (S2=Vd2/Vp) of a circumferential speed (Vd2) of the second developing roller to a circumferential speed (Vp) of the photosensitive body is restricted in a range of 1.5 to 3.5; and said first developing roller and said second developing roller also have a funtion to remove unnecessary toner remaining on said photosensitive body in the relationship of said circumferential speed ratios.

7. An electrophotographic apparatus according to claim 6, wherein an operation of removing unnecessary toner by said first developing roller is larger than that of said second developing roller.

8. An electrophotographic apparatus according to any one of claim 1 and claim 6, wherein developing bias voltages are applied to said first and said second developing rollers, the developing bias voltage applied to said first developing roller being set to approximately ⅓ to ⅔ of a latent image voltage of non-exposed portions, and a developing bias voltage applied to said second developing roller is set to a voltage higher than the developing bias voltage applied to said first developing roller.

9. An electrophotographic apparatus according to claim 6, wherein said blade member is arranged so as to be in opposed contact to the surface of said photosensitive body, and a linear pressure of said blade member, pushed so as to be in contact with the surface of said photosensitive body, is set to 5 to 15 g/cm$^2$.

10. An electrophotographic apparatus according to claim 6, wherein a volume average grain size of said toner is 5 to 12 $\mu$m, and number of the toner particles remaining after cleaning the toner having a toner weight of 0.5 to 1 mg/cm$^2$ on said photosensitive body is approximately 100 to 1000 particles/cm$^2$ at the end of a life-time of said blade member.

11. An electrophotographic apparatus comprising:

an organic photosensitive body having a film thickness of 20 to 60 $\mu$m;

charging means for charging said organic photosensitive body;

exposing means for forming a latent image combining exposed portions and non-exposed portions on said photosensitive body by exposing said charged photosensitive body;

developing means for developing said exposed portions using a first developing roller and a second developing roller rotated in directions opposite to each other and arranged along a moving direction of said photosensitive body, and a developing agent containing a toner to which is added any one of magnetic fine particles of 0.1 to 2 wt % for a toner surface and magnetic fine particles of 0.5 to 20 wt % inside the toner;

cleaning means having a blade member for removing toner remaining on the photosensitive body after transferring a toner image to printing paper, provided so as to push onto a surface of said photosensitive body, wherein the moving direction of said first developing roller is opposite to the moving direction of a photosensitive body, a circumferential speed ratio (S1=Vd1/Vp) of a circumferential speed (Vd1) of the first developing roller to a circumferential speed (Vp) of the photosensitive body being restricted in a range of 0.5 to 2.5;

the moving direction of said second developing roller being equal to the moving direction of said photosensitive body, a circumferential speed ratio (S2=Vd2/Vp) of a circumferential speed (Vd2) of the second developing roller to a circumferential speed (Vp) of the photosensitive body being restricted in a range of 1.5 to 3.5;

a developing bias voltage applied to said first developing roller being restricted to approximately 35 to 70% of a latent image voltage of said non-exposed portions;

a developing bias voltage applied to said second developing roller being restricted to a voltage higher than the developing bias voltage applied to said first developing roller; and a linear pressure of said blade member pushed so as to be in contact to the surface of said photosensitive body being restricted to 5 to 15 g/cm$^2$.

12. An electrophotographic apparatus according to any one of claims 1, 6 and 11, wherein a time required for rotating of said photosensitive body from an exposing position of said exposing means to a position between said first developing roller and said second developing roller corresponds to a photo-response time of said photosensitive body.

13. An electrophotographic apparatus according to any one of claims 1 and 6, wherein at least one of developing bias voltages applied to said first and said second developing rollers is set to a lower value at an initializing time than during a normal printing time.

14. An electrophotographic apparatus according to claim 11, wherein at least one of the developing bias voltages applied to said first and second developing rollers is set to a lower value at an initializing time than during a normal printing time.

* * * * *